US009460648B2

(12) United States Patent
Wang

(10) Patent No.: US 9,460,648 B2
(45) Date of Patent: Oct. 4, 2016

(54) ARRAY SUBSTRATE, DISPLAY PANEL AND DISPLAY DEVICE

(71) Applicant: BOE TECHNOLOGY GROUP CO., LTD., Beijing (CN)

(72) Inventor: Shang Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 7 days.

(21) Appl. No.: 14/446,638

(22) Filed: Jul. 30, 2014

(65) Prior Publication Data

US 2015/0302786 A1 Oct. 22, 2015

(30) Foreign Application Priority Data

Apr. 22, 2014 (CN) ..... 2014 1 0162743

(51) Int. Cl.
*G09G 3/30* (2006.01)
*G09G 3/20* (2006.01)

(52) U.S. Cl.
CPC ..... *G09G 3/20* (2013.01); *G09G 2300/0426* (2013.01); *G09G 2300/08* (2013.01); *G09G 2380/02* (2013.01)

(58) Field of Classification Search
CPC ..... G09G 3/3233; G09G 3/3648
USPC ..... 349/43, 46, 139
See application file for complete search history.

(56) References Cited

U.S. PATENT DOCUMENTS 7,816,856 B2 * 10/2010 Cok ..... H01L 27/3255 313/503
8,305,510 B2 * 11/2012 Jung ..... G02F 1/136286 349/46
2005/0001964 A1 * 1/2005 Kubo ..... G02F 1/1337 349/129
2008/0314626 A1 * 12/2008 Moore ..... G06F 3/0412 174/255
2014/0055429 A1 * 2/2014 Kwon ..... G09G 3/001 345/204

FOREIGN PATENT DOCUMENTS

CN 102013429 A 4/2011
CN 103730476 A 4/2014

OTHER PUBLICATIONS

Office Action dated Mar. 3, 2016 issued in Chinese Application No. 201410162743.9.

* cited by examiner

*Primary Examiner* — Calvin C Ma
(74) *Attorney, Agent, or Firm* — Nath, Goldberg & Meyer; Joshua B. Goldberg; Leonid D. Thenor

(57) ABSTRACT

The invention provides an array substrate, a display panel and a display device, belongs to the field of display technology, and can solve the problem of breakage of metal connecting wirings when the array substrate is bent. The array substrate comprises a plurality of gate lines and a plurality of data lines, wherein at least a part of the gate lines and/or at least a part of the data lines are curved. The display panel in the invention comprises the array substrate, and the display device in the invention comprises the display panel. The invention may be applied to manufacture of a flexible display panel.

12 Claims, 2 Drawing Sheets

ARRAY SUBSTRATE, DISPLAY PANEL AND DISPLAY DEVICE

FIELD OF THE INVENTION

The present invention relates to the field of display technology, and particularly to an array substrate, a display panel and a display device.

BACKGROUND OF THE INVENTION

Currently, a flexible display panel is designed as shown in FIG. 1, the display panel comprises a plurality of gate lines 1 and a plurality of data lines 2 which perpendicularly cross with each other, a gate driving chip 5, and a source driving chip 6 on a base substrate 4, wherein pixel units 3 are provided at crossing points of the gate lines 1 and the data lines 2, the gate driving chip 5 is connected with the gate lines 1 via signal connecting wirings 7 for supplying gate scanning signals to the display panel, the source driving chip 6 is connected with the data lines 2 via signal connecting wirings 7 for supplying source data signals to the display panel, wherein the gate lines 1 and the data lines 2 are usually straight.

The inventor finds that there are at least following problems in the prior art: as the gate lines 1 and the data lines 2 are of straight line type, when the display panel, especially the flexible display panel, is bent due to a tensile stress, metal connecting wirings such as the gate lines 1 and the data lines 2 thereon are easily broken.

SUMMARY OF THE INVENTION

To solve the above problem that the connecting wirings are likely broken when the array substrate is bent, the invention provides an array substrate, a display panel and a display device, which can prevent the connecting wirings from being broken.

A solution adopted to solve the above problem is an array substrate comprising a plurality of gate lines and/or a plurality of data lines, wherein at least a part of the gate lines and/or at least a part of the data lines are curved.

When the array substrate in the invention is bent as an array substrate in the prior art, that is, when they are subjected to the same tensile stress, deformations in the curved gate lines and/or data lines due to the tensile stress are smaller than those in the straight gate lines and/or data lines, as the lengths of the curved gate lines and/or data lines are larger than those of the straight gate lines and/or data lines, therefore, the curved gate lines and/or data lines have stronger bending resistance than the straight gate lines and/or data lines.

For example, each of the at least a part of the gate lines and the at least a part of the data lines has a shape of a curve line including a plurality of periodical shape-units which are arranged continuously (i.e., a curve which is periodically curved), and wherein the periodical shape-unit is S-shaped or sawtooth-shaped.

For example, the plurality of gate lines and the plurality of data lines are arranged to cross with each other, and wherein at least one half of a periodical shape-unit of each data line is provided between any two adjacent gate lines; and at least one half of a periodical shape-unit of each gate line is provided between any two adjacent data lines.

For example, at least M/2 periodical shape-units of each data line are provided between any two adjacent gate lines, wherein M is a positive integer; and at least N/2 periodical shape-units of each gate line is provided between any two adjacent data lines, wherein N is a positive integer.

For example, any one of crossing points of the gate lines and the data lines is positioned at an endpoint or midpoint of a respective periodical shape-unit.

For example, the array substrate is a flexible array substrate.

A solution adopted to solve the above problem is a display panel comprising the above array substrate.

As the display panel in the invention comprises the above array substrate, poor display due to the breakage of the metal connecting wirings when the display panel is bent may be effectively prevented.

For example, the display panel further comprises a source driving chip and a gate driving chip, wherein the plurality of data lines are connected with the source driving chip via signal connecting wirings; and the plurality of gate lines are connected with the gate driving chip via signal connecting wirings.

For example, the signal connecting wirings are straight.

A solution adopted to solve the above problem is a display device comprising the above display panel.

As the display device in the invention comprises the above display panel, the display device has an excellent display even during it is being bent.

DETAILED DESCRIPTION OF THE INVENTION

In order to make persons skilled in the art understand the technical solutions of the present invention better, the present invention will be described in detail below with reference to the drawings and specific embodiments.

Figure 1:
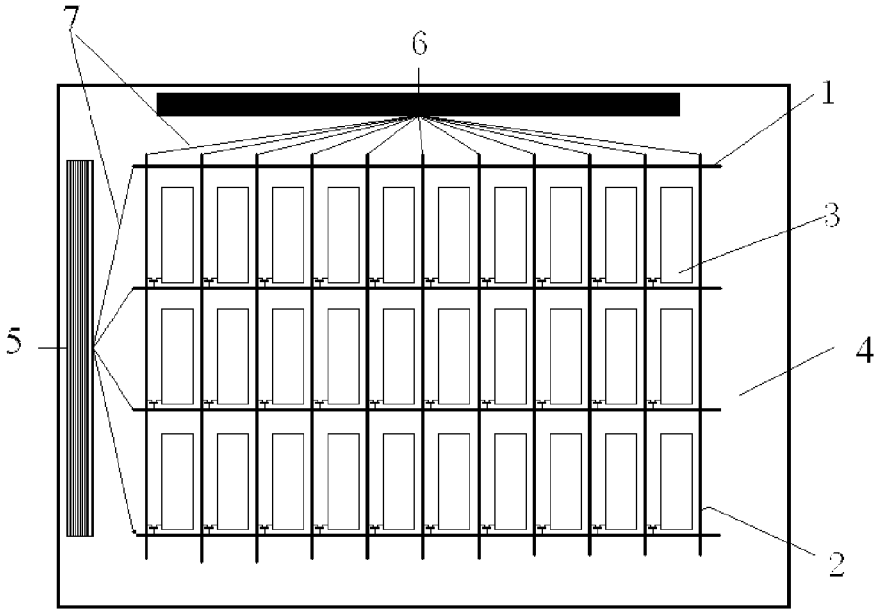
FIG. 1 is a diagram of a display panel in the prior art.
Figure 2:
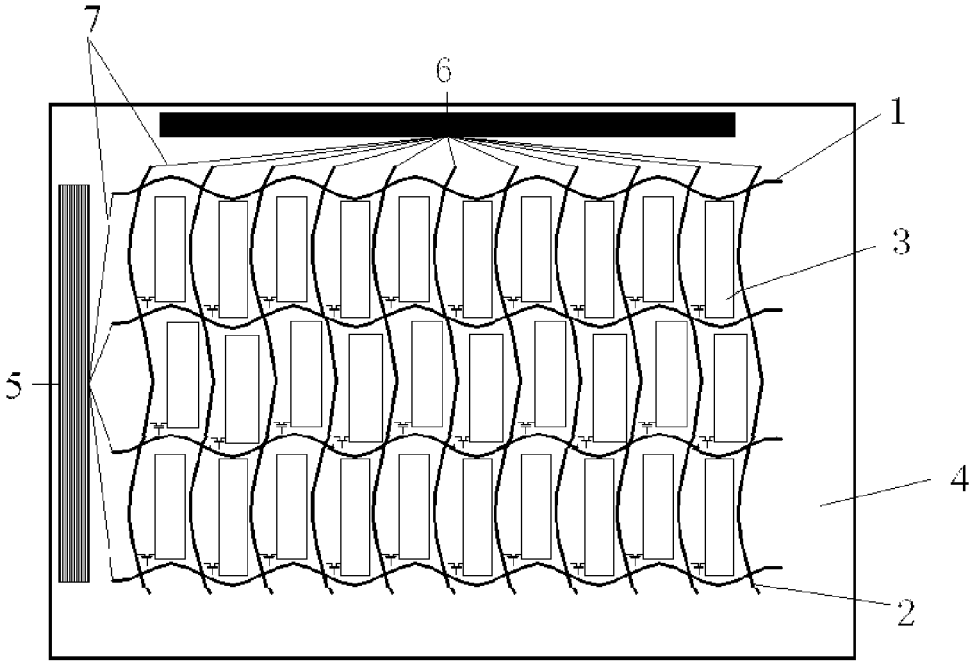
FIG. 2 is a diagram of a display panel in the embodiment 1 and embodiment 2 of the invention.

Embodiment 1:

With reference to FIG. 2, the embodiment provides an array substrate, which comprises a plurality of gate lines 1 and a plurality of data lines 2 provided on a base substrate, wherein the gate lines 1 and the data lines 2 are arranged to cross with each other to define pixel units 3, each of which at least comprises a thin film transistor and a pixel electrode connected thereto, and at least a part of the gate lines 1 and/or at least a part of the data lines 2 are curved.

It should be noted that a data line 2 being a curve in the embodiment means that length of the data line 2 between two adjacent crossing points at two adjacent gate lines 1 is larger than length of a straight line between the two crossing points (in which case, the data line 2 must be curved), and/or a gate line 1 being a curve line means that length of the gate line 1 between two adjacent crossing points at two adjacent data lines 2 is larger than length of a straight line between the two crossing points (in which case, the gate line 1 must be curved), these two cases will fall within the scope of the embodiment.

Figure 3A:
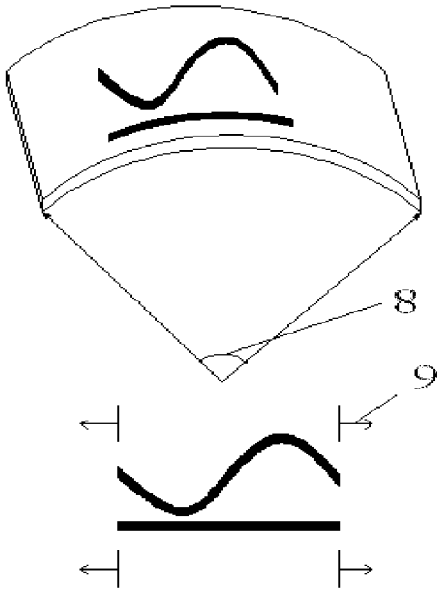
FIG. 3*a* is a diagram illustrating that an array substrate in the embodiment 1 is subjected to a stress when the array substrate is bent.
Figure 3B:
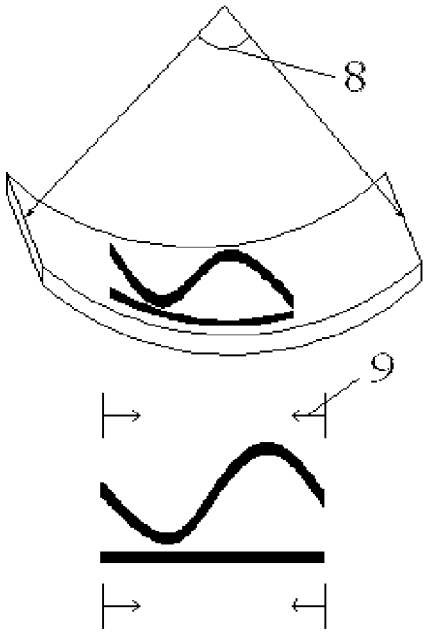
FIG. 3*b* is another diagram illustrating that an array substrate in the embodiment 1 is subjected to a stress when the array substrate is bent.

As shown in FIG. 3*a* and FIG. 3*b*, when the array substrate in the embodiment is bent as an array substrate in the prior art (i.e., they are subjected to the same tensile stress, that is, curvature angles 8 are identical and stress directions are identical), as a curved gate line 1 and/or data line 2 is larger than a straight gate line 1 and/or data line 2 in length, it can be understood that, a deformation of the curved gate line 1 and/or data line 2 due to an external tensile stress is smaller than that of the straight gate line 1 and/or data line 2, and thus the curved gate line 1 and/or data line 2 has a stronger bending resistance.

It should be noted that connecting wirings on the array substrate are not limited to the gate lines 1 and the data lines 2, and include other metal wirings for connecting the elements on the array substrate. These metal wirings may also be of curved shape, and thus when the array substrate is bent, these metal wirings can be prevented from being broken due to a large curvature angle 8.

Preferably, the gate line 1 and the data line 2 each is a curve line comprising a plurality of periodical shape-units which are arranged continuously, and wherein the periodical shape-unit is S-shaped or sawtooth-shaped. That is, the gate line 1 and the data line 2 each is a curve line which is periodically curved, and the curve line is S-shaped or sawtooth-shaped. Of course, the gate line 1 and the data line 2 each may include other shape-units which, for example, may be semi-wave-shaped, sinewave-shaped, or cosine-shaped.

In the embodiment 1, the gate lines 1 and the data lines 2 are all curve lines which are periodically curved, and the curve lines are S-shaped or sawtooth-shaped, thus, when the array substrate is bent, the curved gate lines 1 and the curved data lines 2 may convert tensile stresses into shear stresses, to disperse the shear stresses to each of the gate lines 1 and the data lines 2 more uniformly, therefore the breakage of the gate lines 1 and the data lines 2 due to too large tensile stresses can be effectively avoided. At the same time, the periodical shape-unit may be easily implemented during fabricating the array substrate.

In order to simplify the manufacturing process and make the display of a display panel comprising the array substrate more uniformly, pixel units 3 are defined by the crossing of the gate lines 1 and the data lines 2. In the embodiment, preferably, the gate lines 1 and the data lines 2 are arranged to cross with each other, wherein at least one half of a periodical shape-unit of each data line is provided between any two adjacent gate lines, and at least one half of a periodical shape-unit of each gate line is provided between any two adjacent data lines. It should be understood, length of a data line 2 between two adjacent crossing points at two adjacent gate lines 1 is larger than length of a straight line between the two crossing points (that is, the data line 2 must be curved), and length of a gate line 1 between two adjacent crossing points at two adjacent data lines 1 is larger than length of a straight line between the two crossing points (that is, the gate line 1 must be curved), therefore, deformations of the curved gate line 1 and the curved data line 2 due to an external tensile stress are smaller than those of the straight gate line 1 and the straight data line 2, and thus the curved gate line 1 and the curved data line 2 in the embodiment have stronger bending resistance.

In the embodiment, in order to obtain an uniform display, further preferably, M/2 periodical shape-units of each data line 2 are provided between any two adjacent gate lines 1, wherein M is a positive integer, that is to say, 1/2, 1 or 3/2 periodical shape-units of each data line 2 may be provided between any two adjacent gate lines 1. N/2 periodical shape-units of each gate line 1 are provided between any two adjacent data lines 2, wherein N is a positive integer, that is to say, 1/2, 1 or 3/2 periodical shape-units of each gate line 1 may be provided between any two adjacent data lines 2.

In the embodiment, in order to ensure that the connecting wirings on the array substrate can not be damaged when the array substrate is bent, and in order to save cost as much as possible and facilitate wiring, preferably, half of a periodical shape-unit of each data line 2 is provided between any two adjacent gate lines 1; and half of a periodical shape-unit of each gate line 1 is provided between any two adjacent data lines 2. Moreover, in order to further increase the resolution of the display panel and obtain a more uniform display, further preferably, the crossing points of the gate lines 1 and the data lines 2 are positioned at starting points and mid-points of respective periodical shape-units. As shown in FIG. 2, a first crossing point in the first row (that is, the first one in the first column) is positioned at the starting point of the first periodical shape-unit of the gate line 1 of the first row and the starting point of the first periodical shape-unit of the data line 2 of the first column; a second crossing point in the first row is positioned at the midpoint of the first periodical shape-unit of the gate line 1 of the first row and the starting point of the first periodical shape-unit of the data line 2 of the second column; a third crossing point in the first row is positioned at the starting point of the second periodical shape-unit of the gate line 1 of the first row and the starting point of the first periodical shape-unit of the data line 2 of the third column, the same is true of other rows, and the description thereof will omitted herein. A second crossing point in the first column is positioned at the midpoint of the first periodical shape-unit of the data line 2 of the first column and the starting point of the first periodical shape-unit of the gate line 1 of the second row; a third crossing point in the first column is positioned at the starting point of the second periodical shape-unit of the data line 2 of the first column and the starting point of the first periodical shape-unit of the gate line 1 of the third row, the same is true of other columns, and the description thereof will omitted herein.

Due to the property of the flexible array substrate, the array substrate is likely bent, therefore, the array substrate in the embodiment preferably is a flexible array substrate.

Embodiment 2:

The embodiment provides a display panel comprising the array substrate in the embodiment 1.

As the display panel in the embodiment comprises the above array substrate, breakage of the connecting wirings and thus a poor display due to the excessive stress imposed on the array substrate when the display panel is bent may be avoided.

The display panel in the embodiment preferably further comprises a source driving chip 5 and a gate driving chip 6, wherein the data lines 2 are connected to the source driving chip 6 via signal connecting wirings 7, and the gate lines 1 are connected to the gate driving chip 5 via signal connecting wirings 7.

As the source driving chip 6 and the gate driving chip 5 are non-flexible, the source driving chip 6 and the gate driving chip 5 are provided at non-flexible parts of the display panel, and therefore the signal connecting wirings 7 may be straight metal wirings so as to facilitate wiring and save cost.

Embodiment 3:

The embodiment provides a display device comprising the above array substrate, the display device may be a product or part with display function, such as a mobile phone, pad, TV, display, notebook computer, digital frame, navigator or the like.

The display device in the embodiment comprises the display panel in the embodiment 2, therefore an excellent display may be obtained.

Moreover, the display device in the embodiment may also comprise other common structures, such as a power supply unit, a display driving unit or the like.

It should be understood that, the above embodiments are only used to explain the principle of the present invention, but not to limit the present invention, the person skilled in the art can make various variations and modifications without departing from the spirit and scope of the present invention, therefore, all equivalent technical solutions fall within the scope of the present invention, and the protection scope of the present invention should be defined by the claims.

The invention claimed is:

1. A flexible array substrate comprising a plurality of gate lines and a plurality of data lines, wherein at least a part of the gate lines and/or at least a part of the data lines are curved, and wherein each of the at least a part of the gate lines and the at least a part of the data lines has a shape of a curve line including a plurality of periodical shape-units which are arranged continuously, and wherein the periodical shape-unit is S-shaped.

2. The flexible array substrate of claim 1, wherein the plurality of gate lines and the plurality of data lines are arranged to cross with each other, and wherein at least one half of a periodical shape-unit of each data line is provided between any two adjacent gate lines; and at least one half of a periodical shape-unit of each gate line is provided between any two adjacent data lines.

3. The flexible array substrate of claim 2, wherein at least M/2 periodical shape-units of each data line are provided between any two adjacent gate lines, wherein M is a positive integer; and at least N/2 periodical shape-units of each gate line are provided between any two adjacent data lines, wherein N is a positive integer.

4. The flexible array substrate of claim 3, wherein any one of crossing points of the gate lines and the data lines is positioned at an endpoint or midpoint of a respective periodical shape-unit.

5. The flexible array substrate of claim 2, wherein any one of crossing points of the gate lines and the data lines is positioned at an endpoint or midpoint of a respective periodical shape-unit.

6. The flexible array substrate of claim 1, wherein any one of crossing points of the gate lines and the data lines is positioned at an endpoint or midpoint of a respective periodical shape-unit.

7. A display panel comprising the flexible array substrate of claim 1.

8. The display panel of claim 7, further comprising a source driving chip and a gate driving chip, wherein the plurality of data lines are connected with the source driving chip via signal connecting wirings; and the plurality of gate lines are connected with the gate driving chip via signal connecting wirings.

9. The display panel of claim 8, wherein the signal connecting wirings are straight.

10. A display device comprising the display panel of claim 7.

11. A display device of claim 10, wherein the display panel further comprises a source driving chip and a gate driving chip, wherein the plurality of data lines are connected with the source driving chip via signal connecting wirings; and the plurality of gate lines are connected with the gate driving chip via signal connecting wirings.

12. A display device of claim 11, wherein the signal connecting wirings are straight.

* * * * *